United States Patent [19]

Asselman et al.

[11] 4,254,820

[45] Mar. 10, 1981

[54] HEAT TRANSPORT DEVICE

[75] Inventors: George A. A. Asselman, Eindhoven, Netherlands; Johann Schröder, Aachen, Fed. Rep. of Germany; Faramarz Mahdjuri, Bergamo, Italy

[73] Assignee: U.S. Philips Corporation, New York, N.Y.

[21] Appl. No.: 957,396

[22] Filed: Nov. 3, 1978

[30] Foreign Application Priority Data

Dec. 2, 1977 [DE] Fed. Rep. of Germany ..... 2753660

[51] Int. Cl.[3] ..... F28D 15/00

[52] U.S. Cl. ..... 165/39; 165/105

[58] Field of Search ..... 165/105, 32, 39

[56] References Cited

U.S. PATENT DOCUMENTS

| | | | |
|---|---|---|---|
| 3,112,877 | 12/1963 | Snelling | 165/105 |
| 3,402,761 | 9/1968 | Swet | 165/32 |
| 3,602,429 | 8/1971 | Levedahl et al. | 165/105 X |

*Primary Examiner*—Albert W. Davis

*Attorney, Agent, or Firm*—Thomas A. Briody; William J. Streeter; Rolf E. Schneider

[57] ABSTRACT

There is provided heat transport apparatus comprising a closed tube having an evaporator and a condenser with the condenser being positioned above the evaporator during operation. The closed tube includes a heat transport medium which, during operation, is vaporized in the evaporator and condensed in the condenser, the resulting condensate being returned to the evaporator. A valve is positioned in the closed tube in the condenser region for controlling the condensate return. A pressure-expansion chamber is arranged within the closed tube and is connected to the valve for closing the same when the vapor pressure in the condenser exceeds a given value. A pressure-equalization duct forms part of the valve and provides communication between the evaporator and the condenser.

3 Claims, 8 Drawing Figures

HEAT TRANSPORT DEVICE

Figures 1A, 1B:
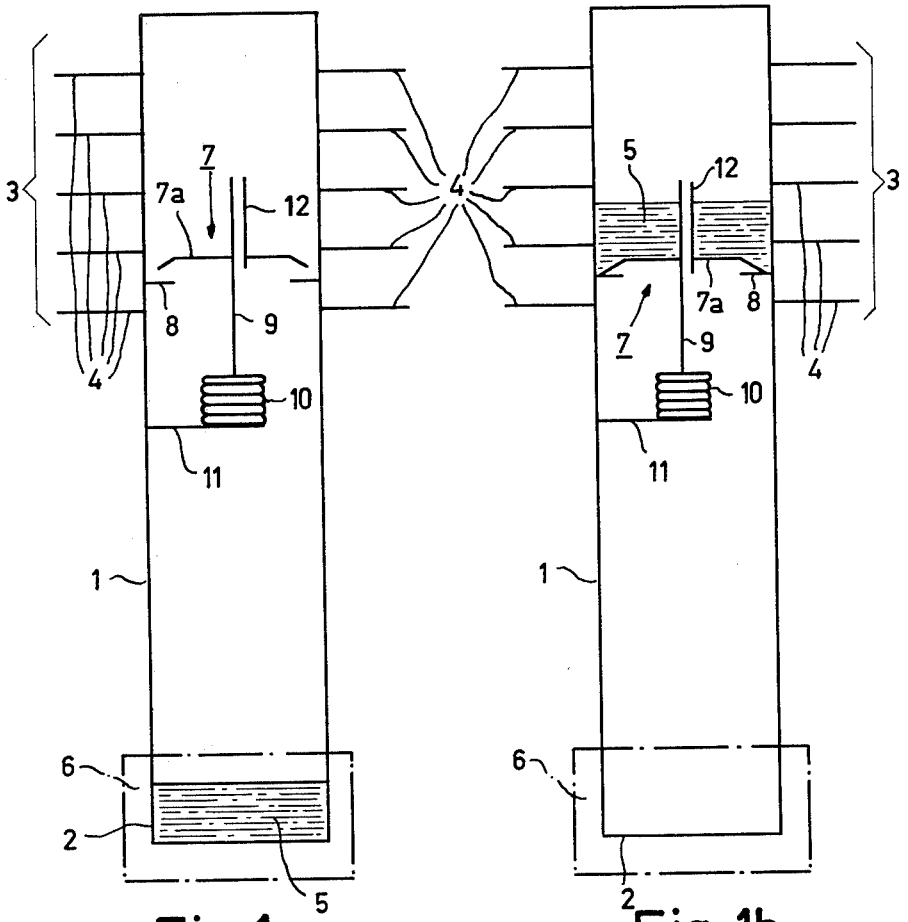

This invention relates to a heat transport device, of the kind comprising an evaporator and a condenser which communicates therewith and which is arranged at a higher level during operation, a heat transport medium which flows from the evaporator to the condenser in the vapour phase and which returns to the evaporator in the liquid phase during operation, and a valve for interrupting the liquid return flow.

A heat transport device of the aforesaid kind is known from French Pat. No. 989,715.

The known device involves a separate vapour duct and a separate liquid return flow duct, which includes a manually operated valve for interrupting the return flow.

The internal pressure of such a heat transport device is determined by the vapour pressure of the heat transport medium at the coldest area, i.e. at the area of the condenser. Therefore, the internal pressure is dependent on the temperature of the condenser.

For many applications, it is desirable that the temperature of the condenser, and hence the quantity of heat given off by the condenser to a heat user, do not exceed a given value, not even when the temperature of the evaporator greatly exceeds this value.

In the aforesaid known device, the return flow of the condensed heat transport medium can be interrupted, so that cooling of the condenser is achieved although, in practice, control of the temperature of the condenser to any given temperature level is substantially impossible by manual operation of the valve.

The object of the present invention is to provide a heat transport apparatus or device of the aforesaid kind in which the temperature of the condenser is automatically limited to a maximum and substantially constant value in a simple manner.

According to the present invention there is provided a heat transport of the aforesaid kind characterized in that the valve is arranged or positioned within the region of the condenser and is operated by a pressure expansion vessel or chamber which is accommodated inside the device and which is subject to the vapour pressure of the heat transport medium, said pressure expansion vessel closing the valve when a given vapour pressure in the condenser is exceeded.

When the valve interrupts the condensate return flow, the condensate collects above the valve. Because the valve is situated within the region of the condenser and because the walls of the condenser subspace bounded by this valve are isothermal, no evaporation condensation cycle can occur inside this space. In the latter case the evaporation zone would be situated at the area of the valve.

Depending on the temperature of the condenser, and hence depending on the internal pressure of the heat transport device, the pressure expansion vessel expands or contracts the valve operated by this vessel providing automatic interruption or release of the condensate return flow.

The present expansion vessel in the externally unloaded condition preferably has an internal pressure which corresponds to the vapour pressure of the heat transport medium associated with a given maximum permissible temperature of the condenser.

An embodiment of the heat transport device is characterized in that the evaporator and the condenser form part of a single closed tube and communicate with each other via a pressure-equalization duct which bypasses the valve.

The pressure expansion vessel may be constructed as a gas-filled bellows.

Alternatively, a mechanical spring may be provided inside the pressure expansion vessel, the pressure expansion vessel then being evacuated or filled with a gas of a given pressure.

Figures 2A, 2B:
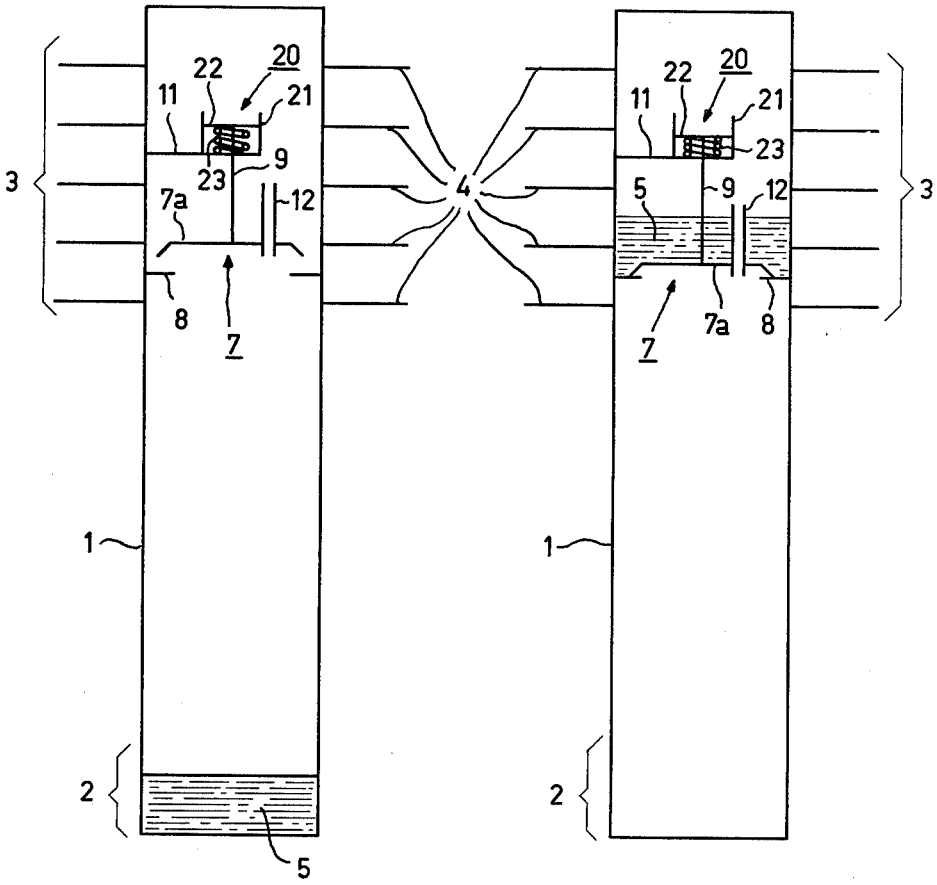

The invention will now be described in more detail with reference to the accompanying drawings, in which:

FIGS. 1*a* and 1*b* are longitudinal diagrammatic views of a tubular heat transport device including an internal pressure equalization duct, the valve being shown in the open condition in FIG. 1*a* and in the closed condition in FIG. 1*b*. *FIGS.* 2*a* and 2*b* are longitudinal diagrammatic views of a tubular heat transport device, including an internal pressure equalization duct and a pressure expansion vessel which is arranged inside the condenser, the valve being shown in the open condition in FIG. 2*a* and in the closed condition in FIG. 2*b*

Figure 3A:
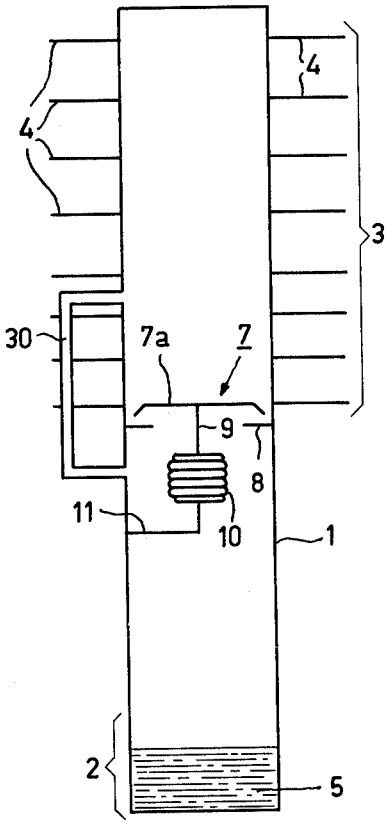
Figure 3B:
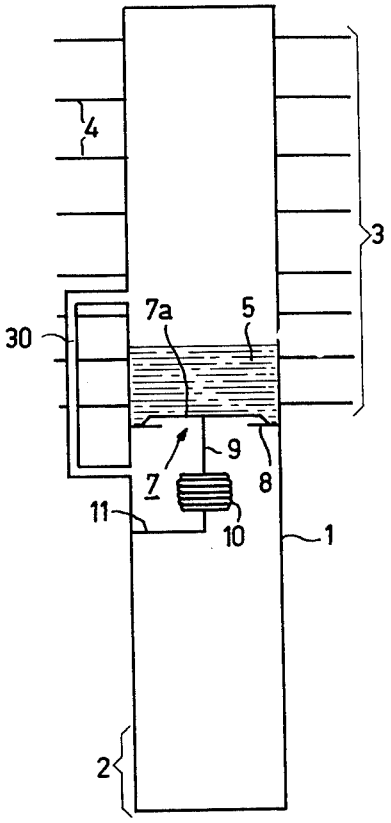

FIGS. 3*a* and 3*b* are longitudinal diagrammatic views of a tubular heat transport device, including an external pressure equalization duct, the valve being shown in the open condition in FIG. 3*a* and in the closed condition in FIG. 3*b* .

Figure 4A:
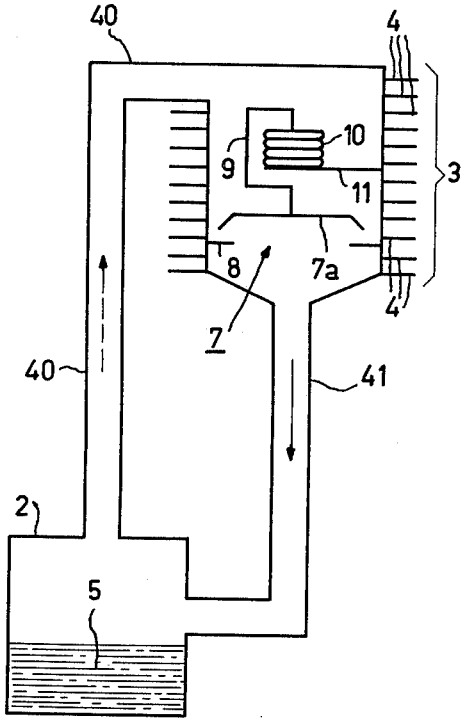

FIG. 4*a* is a diagrammatic sectional view of a heat transport device, including separate vapour and condensate return flow ducts, the valve being shown in the open condition.

Figure 4B:
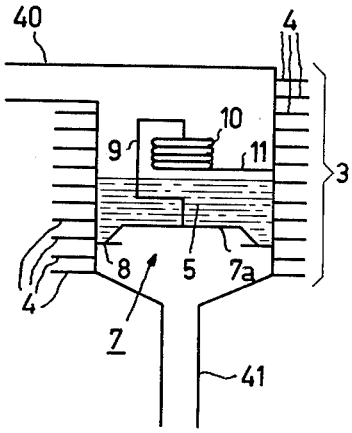

FIG. 4*b* shows the condenser part of FIG. 4*a*, the valve being shown in the closed condition.

Reference numeral 1 in FIGS. 1*a* and 1*b* denotes a closed tube, comprising an evaporator 2 and a condenser 3 which is provided with fins 4 in order to improve the transfer of heat.

The tube 1 contains a heat transport medium 5, for example, water, ammonia or a freon, which can be vaporized under the influence of heat supplied by a heat source 6.

Inside the condenser 3 there is provided a valve 7 which comprises a valve body 7*a* which co-operates with a seat 8. The valve body 7*a* is connected, by way of a rod 9, to a gas-filled bellows 10 which serves as a pressure expansion vessel or chamber. The bellows 10 is secured on its lower side to the wall of the tube 1 by way of a support 11. A pipe 12 which serves as a pressure equalization duct is passed through the valve body 7*a*.

In the externally unloaded condition, the gas pressure inside the bellows 10 corresponds to a vapour pressure of the heat transport medium which corresponds to a maximum permissible condenser temperature.

During operation with the valve 7 in the open condition, the liquid in the evaporator 2 vaporizes. The vapour rises to the condenser 3 where it condenses while giving off heat. The condensate returns to the evaporator 2 under the influence of gravity.

When the condenser temperature is lower than the maximum permissible condenser temperature, the vapour pressure in the tube 1 is lower than the vapour pressure corresponding to the maximum permissible condenser temperature. The gas pressure inside the bellows 10 is then higher than the vapour pressure in the tube 1, and the valve 7 is maintained open by the bellows 10 (FIG. 1*a* ).

When the condenser temperature reaches the maximum permissible value, the vapour pressure is higher than the gas pressure inside the bellows 10, with the result that the upper end thereof is pushed down, so that the valve 7 is closed.

The heat transport medium 5 which vaporizes in the evaporator 2 then enters the condenser 3 via the pressure equalization duct 12 and collects, after condensation, above the valve 7 (FIG. 1*b*). Because the condensate return flow is interrupted, less liquid vaporizes in the evaporator 2 (less boiling at the area of the evaporator wall due to the reduced contact surface area between the evaporator wall and the liquid as the result of a lower liquid level).

The heat transport to the condenser thus decreases. Consequently, the condenser temperature decreases.

As a result of the presence of the pressure equalization duct 12, the valve body 7 is subject to the same vapour pressure on both sides, so that if cannot be pressed upward by a possibly higher vapour pressure at the evaporator side.

When the condenser temperature decreases, the vapour pressure in the tube 1 decreases, the gas pressure in the bellows 10 starts to prevail again, and the valve 7 is opened again. The condensate can then return to the evaporator 2.

The principle of operation of the devices shown in FIGS. 2*a* and 2*b*, FIGS. 3*a* and 3*b*, and FIGS. 4*a* and 4*b* is identical to that of the device shown in FIGS. 1*a* and 1*b*.

The heat transport device shown in FIGS. 2*a* and 2*b* includes an expansion vessel 20 which is arranged inside the condenser 3 and which comprises a rigidly arranged cylinder 21 accommodating reciprocatory piston 22.

The internal pressure of the expansion vessel 20 acting on the piston 22 is given by two components: an enclosed quantity of gas (not shown) and a compression spring 23.

The heat transport device shown in FIGS. 3*a* and 3*b* differs from that shown in FIGS. 1*a* and 1*b* in that an external pressure equalization duct 30 is provided instead of an internal pressure equalization duct.

The heat transport device shown in FIGS. 4*a* and 4*b* includes a vapour duct 40 and a condensate return flow duct 41 which is separate therefrom.

In comparison with FIGS. 1*a* and 1*b* the bellows 10 is now accommodated in the condenser 3.

The vapour duct 40 also serves as a pressure equalization duct.

The inner walls of described heat transport devices except in the region of the valve 7 may be provided with a capillary structure in order to improve the uniform wetting of the evaporator and the condenser and to promote the return of condensate to the evaporator.

The heat transport device is suitable, for example, for use in solar collector systems and heat pump systems or warm water containers in which the water temperature may not exceed a given value (for example, in order to prevent deposition of scale in the container).

What is claimed is:

1. Heat transport apparatus, which comprises a closed tube having an evaporator and a condenser, said condenser being positioned at a higher level than the evaporator during operation, a heat transport medium within said closed tube, said heat transport medium during operation being vaporized in the evaporator with the resulting vapors flowing to the condenser and with said vapors being condensed in the condenser for return of the resulting condensate to the evaporator, a valve positioned in said closed tube in the condenser region for interrupting the condensate return to the evaporator, a pressure-expansion chamber arranged within the closed tube and subject to the vapor pressure of the heat transport medium, said pressure-expansion chamber being connected to the valve and closing the valve when the vapor pressure in the condenser exceeds a given value, and a pressure-equalization duct forming part of said valve and providing communication between the evaporator and the condenser.

2. Heat transport apparatus according to claim 1, in which the pressure-expansion chamber comprises a gas-filled bellows.

3. Heat transport apparatus according to claim 1, in which the pressure-expansion chamber encloses a compression spring.

* * * * *